US005511261A

United States Patent [19]

Collins

[11] Patent Number: 5,511,261

[45] Date of Patent: Apr. 30, 1996

[54] UTILITY TOOL

[76] Inventor: Walter W. Collins, P.O. Box 100, North, S.C. 29112

[21] Appl. No.: 310,047

[22] Filed: Sep. 21, 1994

[51] Int. Cl.[6] ..... B26B 11/00

[52] U.S. Cl. ..... 7/158; 81/438; 81/177.4; 30/162

[58] Field of Search ..... 7/158, 165; 81/177.4, 81/438; 30/162

[56] References Cited

U.S. PATENT DOCUMENTS

| | | |
|---|---|---|
| 174,417 | 3/1876 | Evans . |
| 510,981 | 12/1893 | Massey . |
| 1,275,364 | 8/1918 | Bassisty . |
| 1,716,131 | 6/1929 | Hodgson . |
| 1,853,672 | 4/1932 | Dodson . |
| 1,953,690 | 4/1934 | Samways . |
| 2,074,640 | 3/1937 | Christy . |
| 2,558,965 | 7/1951 | Koenig . |
| 2,737,069 | 3/1956 | Weidel . |
| 3,216,288 | 11/1965 | Gardner . |
| 3,360,807 | 1/1968 | Mauck ..... 7/158 |
| 3,448,518 | 6/1969 | Sklar . |
| 3,857,176 | 12/1974 | Quenot . |
| 4,630,373 | 12/1986 | Staurseth . |

FOREIGN PATENT DOCUMENTS

| | | |
|---|---|---|
| 147457 | 10/1936 | Austria . |
| 340079 | 6/1904 | France . |
| 468583 | 7/1914 | France . |

*Primary Examiner*—James G. Smith

*Attorney, Agent, or Firm*—Leatherwood Walker Todd & Mann

[57] ABSTRACT

A utility tool having a plurality of elongated channels extending the length of a body member. Each tool is provided with a threaded member for selectively locking the tool in a retracted position, an extended position, or a position in between. A central channel is provided which is of a configuration to accept a sliding knife blade or a tool implement of the same cross sectional configuration as is carried by the outboard channels.

15 Claims, 3 Drawing Sheets

UTILITY TOOL

BACKGROUND OF THE INVENTION

This invention relates generally to a utility tool having a plurality of tool members selectively extendable from a holder.

Numerous devices exist which provide multiple tool implements. As a matter of convenience, it is desirable to provide as many implements, such as screwdriver heads, picks, files, socket drivers, etc. in as compact a formas possible, particularly when such device is to be used for a specialized purpose, such as a tool for use with firearms, appliance adjustment, etc. Multi-purpose tools can be particularly desirable to maintain in the glove compartment of an automobile, a backpack, toolbox, tackle box, or the like, for regular or infrequent use, as they provide more utility in a smaller overall package.

However, a drawback of such multi-use tool devices is that because they are generally of a compact design, they can be awkward to use and may also not be rugged or durable enough for heavy or extended use.

Knife and tool holding devices are well-known. For example, U.S. Pat. No. 1,953,690, issued to Samways, discloses a combination tool having implements which may be advanced outwardly from a handle. French Patent No. 340,079, discloses a device which appears to have writing instruments which can be advanced from a holder by means of levers. U.S. Pat. No. 1,275,364, issued to Bassisty, discloses a device having a rectangular casing in which utility tools are provided. The tools are advanced within slots by means of knobs. U.S. Pat. No. 510,981, issued to Massey, discloses a tool which is moveable within a sleeve and is fixable with respect to the sleeve by means of a clamping bolt. U.S. Pat. No. 1,853,672, issued to Dodson, and U.S. Pat. No. 2,737,069, issued to Weindel, each disclose devices having retractable implement members. U.S. Pat. No. 2,558,965, issued to Koenig, discloses a feeler gauge holder having feeler gauges pivotable outwardly from a housing.

A problem may arise in using the prior art devices in that they may be bulky, awkward to use, and/or inefficient to manufacture or operate. Additionally, it would be desirable to have a device where the actual tool implements can be changed, reversed, and/or reoriented, if desired.

SUMMARY OF THE INVENTION

It is the principal object of this invention to provide a utility tool having a plurality of tools slidingly extendable therefrom.

It is another object of the invention to provide a utility tool having a plurality of tools which may be interchanged with one another.

It is a further object of the present invention to provide a utility tool which allows for a significant amount of torque to be delivered by a tool implement.

It is another object of the present invention to provide a utility tool having an extendable knife blade.

It is yet another object of the present invention to provide a utility tool having implements which may be extended and locked into place during use.

It is still another object of the present invention to provide a utility tool having means for locking tool implements extended at various lengths.

These and other aspects of the present invention will become further evident upon reference to the following drawings and accompanying specification.

BRIEF DESCRIPTION OF THE DRAWINGS

The foregoing, as well as other objects of the present invention, will be further apparent from the following detailed description of the preferred embodiment of the invention, when taken together with the accompanying drawings, in which.

DESCRIPTION OF THE PREFERRED EMBODIMENT

Figure 1:
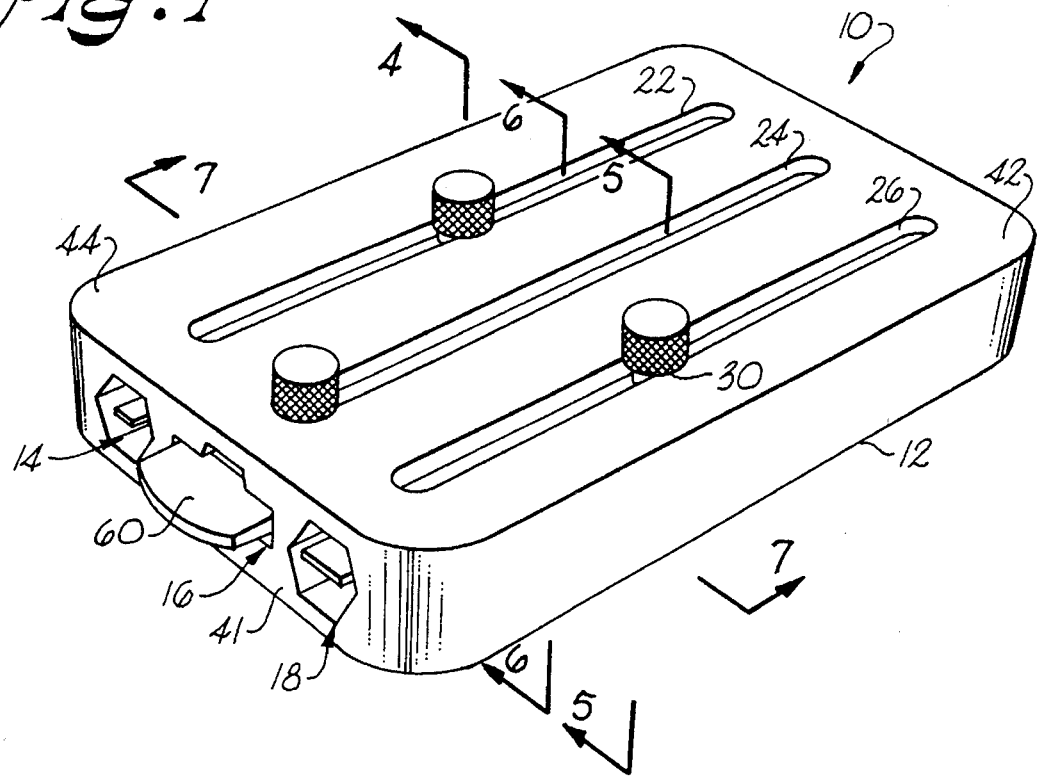
FIG. 1 is perspective view of a utility tool constructed in accordance with the present invention.
Figure 2:
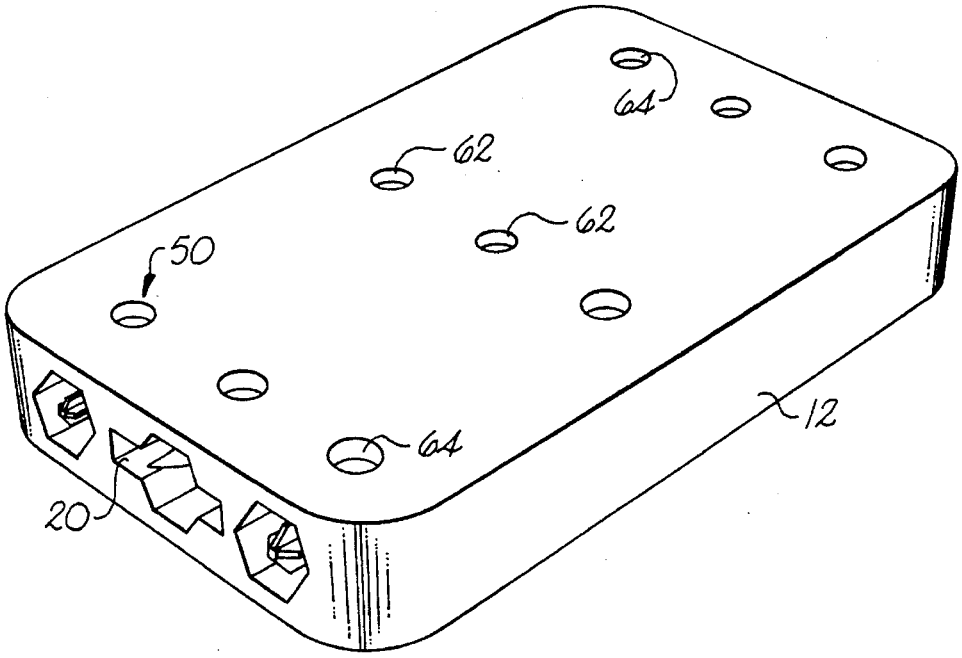
FIG. 2 is a perspective view illustrating the lower portions of a utility tool constructed in accordance with the present invention.

Referring to the drawings in detail, wherein like reference characters represent like elements or features throughout the various views, the utility tool of the present invention is designated generally in the figures by reference character 10.

The utility tool 10 of the present invention is illustrated in FIGS. 1 through 7. FIG. 1 illustrates utility tool 10 as having an elongated body member, generally 12, of a substantially rectangular box shape. The body member 12 includes three parallel channels, generally 14, 16, 18, extending the length of the elongated body member 12. Body member 12 is preferably constructed of metal, glass-filled nylon, plastic, wood, or some other suitable material.

Figure 7:
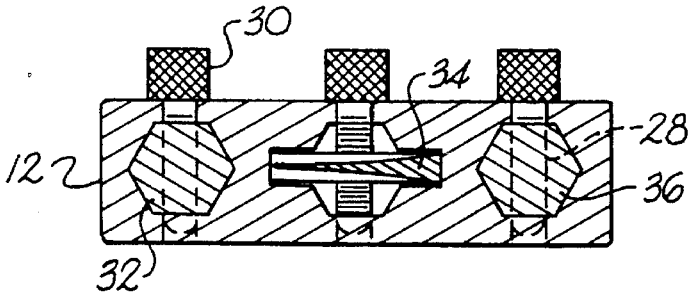
FIG. 7 is a sectional view taken along lines 7—7 of FIG. 1.

As shown in FIG. 7, the channels have a hexagonal cross section, although a variety of other cross sections, such as octagonal, square, ridged, etc. could also be used. The central channel 16 includes a transversely extending, rectangular cross-section, slot 20 which extends the length of the channel 16.

Figure 3:
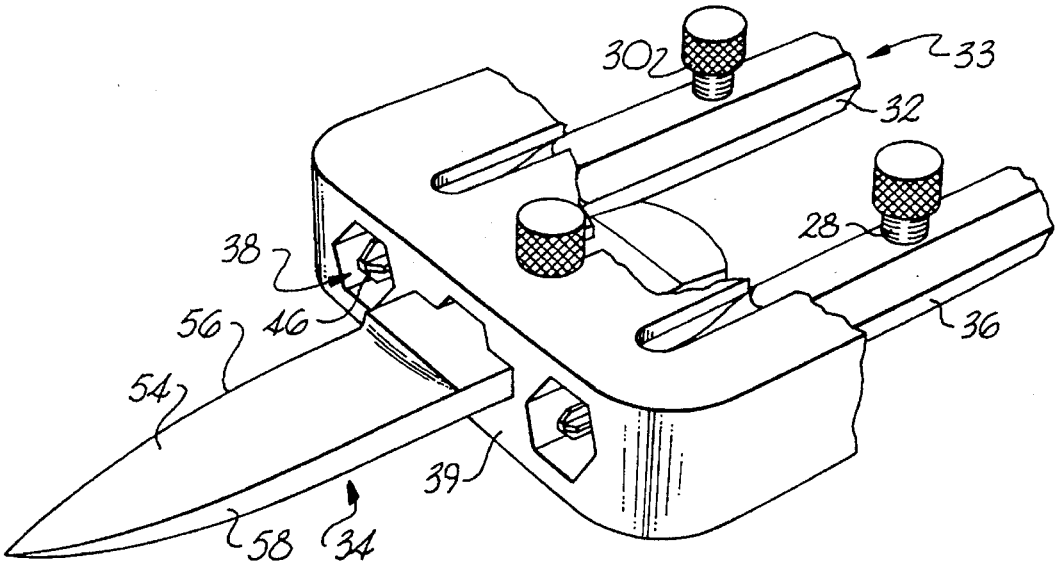
FIG. 3 is a perspective view, with parts cut away, of a utility tool constructed in accordance with the present invention.
Figure 4:
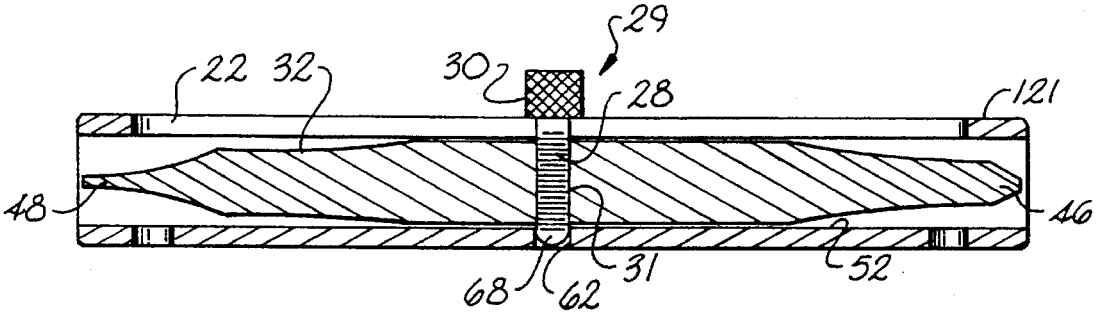
FIG. 4 is a sectional view taken along lines 4—4 of FIG. 1.
Figure 5:
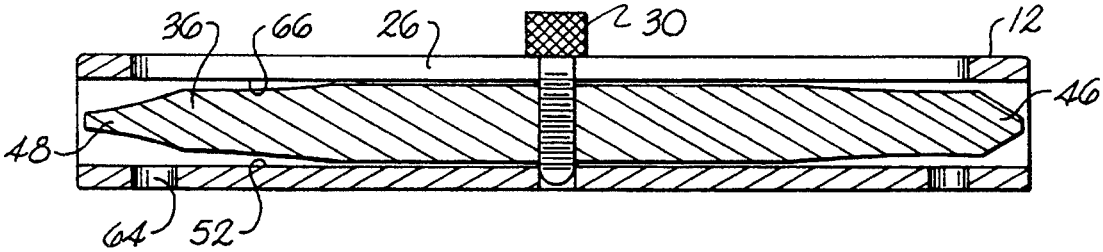
FIG. 5 is a sectional view taken along lines 5—5 of FIG. 1.
Figure 6:
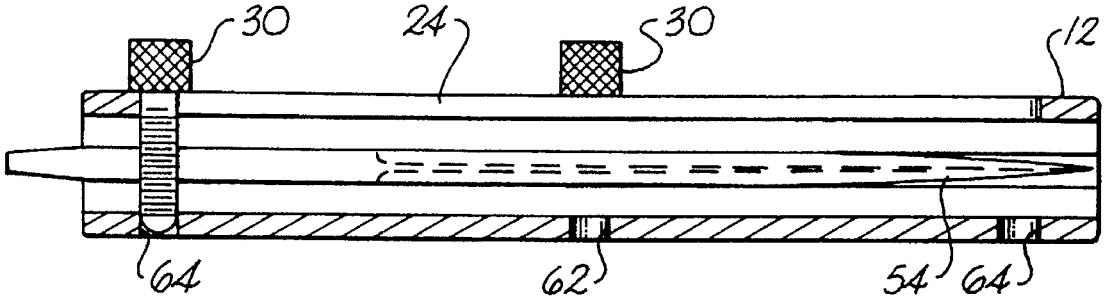
FIG. 6 is a sectional view taken along lines 6—6 of FIG. 1.

As shown in FIGS. 1 and 3, each channel is in communication with a longitudinally extending slot 22, 24, 26 through which a screw shaft 28 of a threaded, or locking, member, generally 29, may pass. A knurled head 30 is provided on each threaded screw shaft 28, and each threaded screw shaft 28 is received in a threaded bore 31, as shown in FIG. 4, provided on a respective tool member, generally 33, slidingly carried in a respective channel.

Utility tool 10 is illustrated as having three elongated tool members 32, 34, 36 in the figures. Each tool member 32, 36 includes a driver, generally 38, defined thereon. Each tool member may be extended outwardly from two faces 39, 41 of body member 12, one of which is provided on each end 42, 44, respectively, of the elongated body member 12. Although the outboard tool members 32, 36 are shown in the drawings as having screwdriver ends, such as Phillips drivers 46 and flat blade drivers 48, a variety of other types of tool implements could also be provided, depending on the desired use for the utility tool. For example, Allen wrenches or torx drivers could be provided, if desired. If the utility tool 10 is to be configured to be used by a hunter or shooter, it may include Allen wrenches, screwdrivers having various head configurations, etc. to be used in particular in connection with firearms.

Tool members 32, 34, 36 are preferably constructed of tool steel, although any other suitable metal or other material could also be used. Tool member 34 is illustrated as being a knife blade 54 which is preferably constructed of cutlery steel or the like.

Provided in the base of the body member are locking bores, generally 50, which are configured to receive the end of the threaded screw shaft 28, when a tool member 32, 34, 36 is extended or retracted to a pre-determined position with respect to the body member 12. Bores 50 can be threaded (not shown) for threadingly receiving screw 28, or unthreaded. Also, and importantly, the threaded member 29 can be used to lock a tool member in a desired extension from the body member 12 at intermediate positions along a channel, in between the locking bores 50. The threaded member 29 is simply rotated until it engages the opposite side wall 52 of the channel to therefor bind the tool member in the channel and against inward or outward movement therefrom.

The central channel 24 is shown as carrying knife blade 54 having a sharpened edge 56 and a flat edge opposite 58 the sharpened edge. On the other end of the knife blade 54 is provided an extension 60 which can be used as a coin or wide blade screwdriver would normally be used for operating or adjusting large-headed screws, scope sights, etc. The central channel 16 of the body member 12 includes the transverse-running slot 20 which carries the blade 54 for sliding movement within the channel 16. However, because of the hexagonal cross-section of the central slot 16 onto which the slot 20 profile is imposed, either of the two outboard members 32, 36 could also be inserted in the central channel 16, upon removal of the knife blade 54. Thus, if additional tool implements were desired, and the knife blade 54 was not needed, the knife blade could be removed, and an additional tool member inserted into the central channel 16, potentially offering at least two additional tool members which could be provided to the utility tool 10.

The interchangeability of the tool members allows the tool members to be placed in either of the outboard channels if necessary, for example, for clearance purposes, or to allow additional torque to be applied to the tool member by the body member 12. Maximum torque with a tool member is achieved, when a tool member is in an outboard channel 14 or 18, and body member 12 is rotated, due to a longer moment arm being provided by the outboard channels—further distance from the central axis of body member 12.

It is also to be understood that the means associated with the tool members for selectively fixing each of them in a retracted or extended position could be other than the threaded members 29 shown. For example, a spring-biased button, lever, pin, or the like, could also be used to lock the tool members in various stages of extension or retraction from the body member 12, if desired. Such means could be used in conjunction with notches or teeth provided in the channel to allow selective extension and retraction of the tool members.

As illustrated in FIG. 1, when knife blade 54 is fully retracted, the threaded member 31 connected to knife blade 54 is at an extreme end of slot 24. This allows for the fullest extension of the knife blade 54 from body 12 to maximize the length and use of cutting edge 56. Coin portion 60 is illustrated as extending outwardly from body 12 when knife 54 is in a fully retracted position. However, coin portion 60 could be modified or eliminated such that the end of tool member 34 did not extend past body 12, if desired. Also, other tool members could be used which are configured similarly as blade 54 to extend outwardly from body 12 by a distance approximately the length of a slot 22, 24, or 26, thus giving the tool implement a longer reach, or clearance between the end of the tool implement and body 12.

In use, the user would select the tool member desired and would unscrew the threaded member 29 to the extent that the threaded shaft 28 clears the retracted bore 62, provided in the bottom of the body member 12. The user would then use the knurled head 30 of the threaded member 29 to advance the desired tool member outwardly from the body member 12 such that the end of the threaded member becomes in alignment with an extension locking bore 64 provided in the body member 12. The threaded member 29 would then be screwed in a tightening direction such that it engaged the locking bore 64 and such that the knurled head 30 was securely fixed against the top surface of the body member. Alternately, if full extension of the tool member was not desirable, the threaded member 29 could be unscrewed from the retraction bore 62 and the tool advanced to the desired extension. The threaded member 29 would then be rotated until it engaged against the opposite wall 52 of the channel in such way that the tool would be bound into place, being forced against the upper wall 66 of the channel by virtue of the threaded member passing through the tool and engaging with the opposing wall 52. This effectively allows extension of the tools in a variety of positions. Further, it is to be understood that threaded member 29, in addition to acting as a locking mechanism, also acts as a means against which the user pushes to extend or retract the tool members.

To retract the tool, the threaded member 29 is simply unscrewed in the opposite direction such that the end of the threaded member clears the extension bore 64, and the tool is then moved to its retracted position through the pushing of the knurled head 30 until the end 68 of the threaded member is in alignment with the retracted bore 62. The knurled head is then turned in the tightening direction such that the end of the threaded shaft fully engages with the retraction bore 62.

To remove a tool, the threaded member 29 is simply unscrewed entirely from the tool member, and the tool member is extracted from the channel in which it resides. Another tool member can then be put in its place in the same channel, or, as discussed above, an outboard tool member, for example, could be placed in the central channel, once the blade has been removed in a likewise manner, if desired.

The utility tool 10 of the present invention provides a compact device which effectively allows for six tool implements to be provided in a minimum amount of space. Because of the construction, a significant amount of torque and leverage can be used with the implements. It is to be understood, however, that the present invention is not limited to simply three channels and three tool members, and that a body member with 2, 4, or otherwise more or less channels and tools could also be used. Additionally, the tool implements shown are for illustrative purposes, and that any number of other implements could also be used.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art, without departing from the spirit or scope of the following claims.

What is claimed is:

1. A utility tool, comprising:

an elongated body member having a first end and a second end opposite said first end, said elongated body member defining a first channel extending the length of said body member and being open to said first and second ends of said elongated body member;

said elongated body member defining a second channel extending the length of said body member and being open to said first and second ends of said elongated body member;

a first elongated tool member slidingly carried in said first channel and a having a first end and a second end opposite said first end, each of said first and second ends of said first elongated tool member being selectively extendable from said elongated body member; said first elongated tool member having a first cross-sectional shape;

a second elongated tool member separate and apart from said first elongated tool member slidingly carried in said second channel and having a first end and a second end opposite said first end, each of said first and second ends of said second elongated tool member being selectively extendable from said elongated body member; said second elongated tool member having a second cross-sectional shape;

each of said first and second tool members being moveable in said first and second channels, respectively, between a retracted position substantially within said body member, to an extended position wherein one of said first and second ends extends outwardly from said body member;

said first channel including a second cross-sectional track of said second cross-sectional shape defined therein which extends the length of said elongated body member;

said first channel being configured for selectively carrying said second elongated tool member for sliding movement therein instead of said first elongated tool member; and locking means associated with said first and second tool members for selectively fixing each of said first and second ends of said first and second tool members in said retracted position and in said extended position.

2. A utility tool as defined in claim 1, wherein said first and second channels are each of a substantially hexagonal cross-sectional shape.

3. A utility tool as defined in claim 1, wherein at least one of said first and second channels includes a rectangular cross-sectional track defined therein which extends the length of said elongated body member.

4. A utility tool as defined in claim 1, wherein said locking means includes means for selectively fixing each of said first and second elongated tool members in each of various extensions from said elongated body member.

5. A utility tool as defined in claim 1, wherein said locking means is a screw.

6. A utility tool as defined in claim 3, wherein said second cross-sectional shape of said second elongated tool member is substantially rectangular and said second elongated tool member includes a knife blade and is carried for sliding movement in said track.

7. A utility tool as defined in claim 1, wherein said first channel defines a retraction recess for receipt of said locking means when said first tool member carried therein is in said retracted position and an extension recess for receipt of said locking means when said first tool member is in said extended position.

8. A utility tool as defined in claim 1, wherein said first channel is of a substantially hexagonal cross-sectional shape having said rectangular cross-sectional track defined therein; and said first cross-sectional shape of said first tool member being substantially hexagonal for allowing cooperating sliding movement of said first elongated tool member in said first channel.

9. A utility tool as defined in claim 1, wherein said first elongated channel is of a substantially hexagonal cross-sectional shape and has said rectangular cross-sectional track defined therein; and wherein said second cross-sectional shape of said second elongated tool member is substantially rectangular and said second elongated tool member includes a knife blade carried for sliding movement in said track.

10. A utility tool as defined in claim 1, further comprising a first elongated slot in communication with said first channel and a second elongated slot in communication with said second channel; said first and second elongated slots each being for receipt of said locking means.

11. A utility tool as defined in claim 1, further comprising extension and retraction means associated with said first and second tool elongated members for selectively moving each of said first and second elongated tool members between said extended and retracted positions.

12. A utility tool as defined in claim 11, wherein said locking means is connected to each of said first and second elongated tool members and further includes said extension and retraction means.

13. A utility tool as defined in claim 1, wherein said second elongated tool member includes a knife blade and further includes a blade screwdriver extending outwardly from said elongated body member when said second tool member is in said retracted position.

14. A utility tool, comprising:

an elongated body member having a first end and a second end opposite said first end, and a longitudinally-extending central axis; said elongated body member defining first and second longitudinally-extending channels extending the length of said body member and being open to said first and second ends of said elongated body member; said first channel extending substantially co-axially with said central axis and said second channel being laterally spaced from and substantially parallel to said central axis;

an elongated tool member slidingly carried in each of said first and second channels, each elongated tool member having a first end and a second end opposite said first end, each of said first and second ends of each said elongated tool member being selectively extendable from said elongated body member;

each said elongated tool member being moveable in one of said first and second channels between a retracted position substantially within said body member, to an extended position wherein one of said first and second ends of said elongated tool member extends outwardly from said body member; and said elongated body member being configured for allowing rotative force to be transmitted from said elongated body member to said elongated tool members for rotating each of said tool members, and said elongated body member having means for positioning at least one of said elongated tool members in at least two positions with respect to said central axis of said elongated body member.

15. A utility tool as defined in claim 14, further comprising locking means associated with said at least one of said elongated tool members for selectively fixing each of said first and second ends thereof in said retracted position and in said extended position.

* * * * *